US007735821B2

(12) United States Patent
Sawai

(10) Patent No.: US 7,735,821 B2
(45) Date of Patent: Jun. 15, 2010

(54) IMAGE GENERATING APPARATUS AND THERMAL TRANSFER PRINTER

(75) Inventor: Kunio Sawai, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 216 days.

(21) Appl. No.: 11/407,067

(22) Filed: Apr. 20, 2006

(65) Prior Publication Data

US 2006/0291940 A1 Dec. 28, 2006

(30) Foreign Application Priority Data

Jun. 27, 2005 (JP) ..... 2005-186832

(51) Int. Cl.
*B65H 3/06* (2006.01)

(52) U.S. Cl. ..... 271/109; 271/207

(58) Field of Classification Search ..... 271/109, 271/207

See application file for complete search history.

(56) References Cited

U.S. PATENT DOCUMENTS 5,667,321 A 9/1997 Sago
5,921,691 A 7/1999 Kobayashi et al.
2004/0095593 A1 5/2004 Chung et al.

FOREIGN PATENT DOCUMENTS

EP 0 622 226 A2 11/1994
EP 1 000 762 A2 5/2000
JP 2003-191552 A 9/2003

OTHER PUBLICATIONS

European Search Report dated Oct. 31, 2006 (Seven (7) pages).

*Primary Examiner*—Patrick Mackey
*Assistant Examiner*—Luis Gonzalez
(74) *Attorney, Agent, or Firm*—Crowell & Moring, LLP

(57) ABSTRACT

An image generating apparatus capable of reducing the number of components and discharging a paper with a simple structure is obtained. This image generating apparatus comprises a feed roller for carrying a paper, a paper discharge roller coming into contact with the lower surface of the paper for discharging the paper carried by the feed roller and a paper support member arranged at a prescribed interval from the axial center of the paper discharge roller in a paper feed direction while supporting the upper surface of the paper so that the lower surface of the paper discharged by the paper discharge roller comes into contact with the paper discharge roller with prescribed contact force, and the paper discharge roller discharges the paper with frictional force generated between the paper discharge roller and the lower surface of the paper coming into contact with the paper discharge roller with the prescribed contact force.

4 Claims, 6 Drawing Sheets

IMAGE GENERATING APPARATUS AND THERMAL TRANSFER PRINTER

BACKGROUND OF THE INVENTION

1. Field of the Invention

The present invention relates to an image generating apparatus and a thermal transfer printer, and more particularly, it relates to an image generating apparatus and a thermal printer each comprising a paper discharge roller.

2. Description of the Background Art

A thermal transfer printer discharging a printed paper in a state held between a paper discharge roller and a paper support roller coming into contact with the paper discharge roller with prescribed pressing force is known in general. The structure of an exemplary conventional thermal transfer printer 100 is described with reference to FIG. 11.

As shown in FIG. 11, the exemplary conventional thermal transfer printer 100 comprises a chassis 101, an ink sheet cartridge 102 storing an ink sheet 102*a*, a feed roller 103, a press roller 104 pressing the feed roller 103 with prescribed pressing force, a print head 105 for printing, a platen roller 106 opposed to the print head 105, a paper feed roller 107, a paper discharge roller 108, a paper press roller 109, a spring member 110 for pressing the paper press roller 109 with prescribed pressing force, a lower paper guide 111 and an upper paper guide 112.

The chassis 101 is provided with an ink sheet receiving hole 110*a* for receiving the ink sheet cartridge 102. The ink sheet cartridge 102 inserted into the ink sheet cartridge receiving hole 110*a* stores the ink sheet 102*a*.

The feed roller 103 is rotatably provided on the chassis 101, and has a function of carrying a paper 150 in a paper feed direction (along arrow A in FIG. 11) and a paper discharge direction (along arrow B in FIG. 11). The press roller 104 presses the feed roller 103 with the prescribed pressing force. Thus, the paper 150 can be held between the feed roller 103 and the press roller 104 and carried in the paper feed direction (along arrow A in FIG. 11) and the paper discharge direction (along arrow B in FIG. 11) in the state held between the rollers 103 and 104. A head portion 105*a* for printing is provided on the print head 105 rotatably about the support shaft 105*b*, and rotated toward the platen roller 106 for printing.

The paper feed roller 107 is provided for feeding the paper 150 to a printing position for performing printing with the head portion 105*a* of the print head 105. The paper discharge roller 108 is provided for discharging the printed paper 150 subjected to the printing with the head portion 105*a* of the print head 105. The paper press roller 109 has an axial center perpendicularly separated from the axial center of the paper discharge roller 108 at a prescribed interval. In other words, the perpendicular positions of the axial centers of the paper discharge roller 108 and the paper press roller 109 coincide with each other. The paper press roller 109 comes into contact with the paper discharge roller 108 with prescribed pressing force through the spring member 110. Thus, the printed paper 150 subjected to the printing with the head portion 105*a* of the print head 105 can be held between the paper discharge roller 108 and the paper press roller 109 and carried in the paper discharge direction (along arrow B in FIG. 11) in the state held between the rollers 108 and 109.

The lower paper guide 111 is set in the vicinity of the paper feed roller 107. This lower paper guide 111 has a function of passing the paper 150 fed by the paper feed roller 107 through the upper surface of the lower paper guide 111 in paper feeding thereby guiding the paper 150 to a paper feed path toward the print head 105. The upper paper guide 112, supported by the lower paper guide 111, has a function of passing the paper 150 carried by the feed roller 103 through the upper surface of the upper paper guide 112 thereby guiding the paper 150 to a paper discharge path of the paper discharge roller 108.

An ink jet recording apparatus is also generally as an exemplary image generating apparatus comprising a carrier roller, as disclosed in Japanese Patent Laying-Open No. 2003-191552, for example.

In this ink jet recording apparatus disclosed in Japanese Patent Laying-Open No. 2003-191552, a suction hole is provided on the outer peripheral surface of a paper discharge drive roller (paper carrying roller), and a fan unit is connected to the paper discharge drive roller for sucking air through the suction hole. Thus, a paper carried by the carrier roller (feed roller) is discharged by driving the paper feed drive roller while adsorbing the paper on the outer peripheral surface of the paper discharge drive roller.

However, the conventional thermal transfer printer 100 shown in FIG. 11 must disadvantageously be provided with the spring member 110 pressing the paper press roller 109 against the paper discharge roller 108 with the prescribed pressing force, in order to discharge the printed paper 150 held between the paper discharge roller 108 and the paper press roller 109 coming into contact with the paper discharge roller 108 with the prescribed pressing force. Therefore, the number of components is disadvantageously increased.

In the ink jet recording apparatus disclosed in the aforementioned Japanese Patent Laying-Open No. 2003-191552, the suction hole must be provided on the outer peripheral surface of the paper discharge drive roller while the fan unit must be connected to the paper discharge drive roller, in order to discharge the paper carried by the carrier roller. Consequently, a paper discharge mechanism for discharging the paper is disadvantageously complicated.

SUMMARY OF THE INVENTION

The present invention has been proposed in order to solve the aforementioned problems, and an object of the present invention is to provide an image generating apparatus and a thermal transfer printer each capable of reducing the number of components and discharging a paper with a simple structure.

In order to attain the aforementioned object, an image generating apparatus according to a first aspect of the present invention comprises a feed roller for carrying a paper, a paper discharge roller coming into contact with the lower surface of the paper for discharging the paper carried by the feed roller and a paper support member arranged at a prescribed interval from the axial center of the paper discharge roller in a paper feed direction while supporting the upper surface of the paper so that the lower surface of the paper discharged by the paper discharge roller comes into contact with the paper discharge roller with prescribed contact force, and the paper discharge roller discharges the paper with frictional force generated between the paper discharge roller and the lower surface of the paper coming into contact with the paper discharge roller with the prescribed contact force.

In the image generating apparatus according to the first aspect, as hereinabove described, the paper support member is arranged at the prescribed interval from the axial center of the paper discharge roller in the paper feed direction while supporting the upper surface of the paper so that the lower surface of the paper discharged by the paper discharge roller comes into contact with the paper discharge roller with the prescribed contact force, whereby upward movement of an end of the upper surface of the paper in the paper feed direction can be supported by the paper support member provided at the prescribed interval from the axial center of the paper discharge roller in the paper feed direction when the center of gravity of the paper moves in a paper discharge direction with respect to the axial center of the paper discharge roller after the paper carried by the feed roller is separated from the feed roller. When the paper support member supports the end of the upper surface of the paper in the paper feed direction in the aforementioned manner, force for pressing the lower surface of the paper against the paper discharge roller so acts that frictional force can be generated between the paper discharge roller and the paper. Therefore, the paper discharge roller can carry the paper along the paper discharge direction. Consequently, the paper can be carried in the paper discharge direction with no urging member such as a spring member dissimilarly to a case of carrying the paper by urging the paper support member toward the paper discharge roller with an urging member such as a spring member thereby generating frictional force between the paper discharge roller and the paper, whereby the number of components can be reduced due to the unnecessariness for the urging member such as a spring member. Further, this image generating apparatus can discharge the paper with the simple structure of providing the paper support member at the prescribed interval from the axial center of the paper discharge roller in the paper feed direction.

In the aforementioned image generating apparatus according to the first aspect, the paper support member is preferably provided between the feed roller and the paper discharge roller for supporting the rear end of the paper, carried by the feed roller, upwardly moving with reference to a supporting point formed by the paper discharge roller due to the own weight of a portion of the paper passing through the paper discharge roller. According to this structure, the upward movement of the end of the paper in the paper feed direction can be easily supported when the center of gravity of the paper moves in the paper discharge direction with respect to the axial center of the paper discharge roller.

In the aforementioned image generating apparatus according to the first aspect, the paper support member is preferably provided in a rotatable manner. According to this structure, the upper surface of the paper can be smoothly carried through rotation of the paper support member following movement of the paper carried in the paper discharge direction when the paper discharge roller carries the lower surface of the paper in the paper discharge direction while the paper support member supports the end of the upper surface of the paper. Also when the upper surface of the paper supported by the paper support member is printed, the paper can be so smoothly carried by the rotatable paper support member that the printed paper can be discharged without damaging the state of an image such as a photograph formed on the printed surface of the paper.

In the aforementioned image generating apparatus according to the first aspect, the paper support member is preferably made of resin, and the paper discharge roller preferably includes a roller portion of rubber. According to this structure, frictional force generated between the discharge roller of rubber and the paper exceeds that generated between the paper support member of resin and the paper, whereby the paper can be easily discharged in the paper discharge direction with the paper discharge roller of resin.

In the aforementioned image generating apparatus comprising the paper support member of resin, the paper support member of resin preferably includes a body portion having a cruciform section and rib portions, having a circular section, provided at a prescribed interval along the extensional direction of the paper support member. When the body portion of the paper support member has the cruciform section as described above, the usage of resin can be reduced as compared with a case of forming a cylindrical paper support member. Further, the rib portions are so provided at the prescribed interval along the extensional direction of the paper support member that the strength of the body portion can be inhibited from reduction despite the reduced usage of resin. In addition, the rib portions have the circular section so that an end of the paper carried by the paper discharge roller can be inhibited from getting caught on the paper support member, whereby the paper can be smoothly carried.

In this case, the roller portion of the paper discharge roller preferably has a pair of rollers arranged on positions symmetrical with respect to the central position of the width of the paper in a direction perpendicular to a paper discharge direction, and the rib portion of the paper support member are preferably provided on positions corresponding to the pair of rollers. According to this structure, the rib portions so support the upper surface of the paper that the rollers located on the positions corresponding to the rib portions can be uniformly supplied with contact force of the paper. Thus, uniform frictional force is generated between the paper and the pair of rollers of the paper discharge roller, whereby the paper can be straightforwardly discharged in the paper discharge direction.

In the aforementioned image generating apparatus according to the first aspect, the paper discharge roller and the paper support member may be arranged not to come into contact with each other.

In the aforementioned image generating apparatus according to the first aspect, the lower end of the paper support member supporting the upper surface of the paper is preferably positioned below the upper end of the paper discharge roller supporting the lower surface of the paper. According to this structure, an end of the paper can be supported by the lower end of the paper support member positioned below the upper end of the paper discharge roller, whereby the contact force of the paper can be easily supplied to the paper discharge roller. Consequently, the paper can be easily discharged through frictional force between the paper and the paper discharge roller.

In the aforementioned image generating apparatus according to the first aspect, the horizontal distance between an end of the paper discharge roller closer to the paper support member and an end of the paper support member closer to the paper discharge roller is preferably smaller than the outer diameters of the paper discharge roller and the paper support member. According to this structure, the distance between the paper support member and the paper discharge roller can be so reduced as to increase the contact force of the paper coming into contact with the paper discharge roller. Thus, the frictional force generated in paper carriage can also be increased. Consequently, the paper can be easily carried.

The aforementioned image generating apparatus according to the first aspect preferably further comprises a paper guide guiding the paper carried by the feed roller to the paper discharge roller, while the paper is preferably guided toward the paper discharge roller by the paper guide when carried by the feed roller, and supported by the paper support member when separated from the feed roller and carried by the paper discharge roller. According to this structure, the paper separated from the feed roller can be easily guided to the paper discharge roller.

A thermal transfer printer according to a second aspect of the present invention comprises a feed roller for carrying a paper, a paper discharge roller coming into contact with the lower surface of the paper for discharging the paper carried by the feed roller and a rotatably provided paper support member of resin arranged at a prescribed interval from the axial center of the paper discharge roller in a paper feed direction while supporting the upper surface of the paper so that the lower surface of the paper discharged by the paper discharge roller comes into contact with the paper discharge roller with prescribed contact force, the paper discharge roller and the paper support member are arranged not to come into contact with each other, the paper support member is provided between the feed roller and the paper discharge roller for supporting the rear end of the paper, carried by the feed roller, upwardly moving with reference to a supporting point formed by the paper discharge roller due to the own weight of a portion of the paper passing through the paper discharge roller, and the paper discharge roller includes a roller portion of rubber and discharges the paper with frictional force generated between the paper discharge roller and the lower surface of the paper coming into contact with the paper discharge roller with the prescribed contact force.

In the thermal transfer printer according to the second aspect, as hereinabove described, the paper support member is arranged at the prescribed interval from the axial center of the paper discharge roller in the paper feed direction while supporting the upper surface of the paper so that the lower surface of the paper discharged by the paper discharge roller comes into contact with the paper discharge roller with the prescribed contact force, whereby upward movement of an end of the upper surface of the paper in the paper feed direction can be supported by the paper support member provided at the prescribed interval from the axial center of the paper discharge roller in the paper feed direction when the center of gravity of the paper moves in a paper discharge direction with respect to the axial center of the paper discharge roller after the paper carried by the feed roller is separated from the feed roller. When the paper support member supports the end of the upper surface of the paper in the paper feed direction in the aforementioned manner, force for pressing the lower surface of the paper against the paper discharge roller so acts that frictional force can be generated between the paper discharge roller and the paper. Therefore, the paper discharge roller can carry the paper along the paper discharge direction. Consequently, the paper can be carried in the paper discharge direction with no urging member such as a spring member dissimilarly to a case of carrying the paper by urging the paper support member toward the paper discharge roller with an urging member such as a spring member thereby generating frictional force between the paper discharge roller and the paper, whereby the number of components can be reduced due to the unnecessariness for the urging member such as a spring member. Further, this thermal transfer printer can discharge the paper with the simple structure of providing the paper support member at the prescribed interval from the axial center of the paper discharge roller in the paper feed direction.

According to the second aspect, the paper support member is provided between the feed roller and the paper discharge roller for supporting the rear end of the paper, carried by the feed roller, upwardly moving with reference to a supporting point formed by the paper discharge roller due to the own weight of the portion of the paper passing through the paper discharge roller, whereby upward movement of an end of the paper in the paper feed direction can be easily supported when the center of gravity of the paper moves in a paper discharge direction with respect to the axial center of the paper discharge roller. Further, the paper support member is so provided in a rotatable manner that the upper surface of the paper can be smoothly carried through rotation of the paper support member following movement of the paper carried in the paper discharge direction when the paper discharge roller carries the lower surface of the paper in the paper discharge direction while the paper support member supports the end of the upper surface of the paper. Also when the upper surface of the paper supported by the paper support member is printed, the paper can be so smoothly carried by the rotatable paper support member that the printed paper can be discharged without damaging the state of an image such as a photograph formed on the printed surface of the paper. In addition, the paper support member of resin and the paper discharge roller of rubber are so provided that frictional force generated between the discharge roller of rubber and the paper exceeds that generated between the paper support member of resin and the paper, whereby the paper can be easily discharged in the paper discharge direction with the paper discharge roller of resin.

In the aforementioned thermal transfer printer comprising the paper support member of resin, the paper support member of resin preferably includes a body portion having a cruciform section and rib portions, having a circular section, provided at a prescribed interval along the extensional direction of the paper support member. When the body portion of the paper support member has the cruciform section as described above, the usage of resin can be reduced as compared with a case of forming a cylindrical paper support member. Further, the rib portions are so provided at the prescribed interval along the extensional direction of the paper support member that the strength of the body portion can be inhibited from reduction despite the reduced usage of resin. In addition, the rib portions have the circular section so that an end of the paper carried by the paper discharge roller can be inhibited from getting caught on the paper support member, whereby the paper can be smoothly carried.

In this case, the roller portion of the paper discharge roller preferably has a pair of rollers arranged on positions symmetrical with respect to the central position of the width of the paper in a direction perpendicular to a paper discharge direction, and the rib portions of the paper support member are preferably provided on positions corresponding to the pair of rollers. According to this structure, the rib portions so support the upper surface of the paper that the rollers located on the positions corresponding to the rib portions can be uniformly supplied with contact force of the paper. Thus, uniform frictional force is generated between the paper and the pair of rollers of the paper discharge roller, whereby the paper can be straightforwardly discharged in the paper discharge direction.

In the aforementioned thermal transfer printer according to the second aspect, the lower end of the paper support member supporting the upper surface of the paper is preferably positioned below the upper end of the paper discharge roller supporting the lower surface of the paper. According to this structure, an end of the paper can be supported by the lower end of the paper support member positioned below the upper end of the paper discharge roller, whereby the contact force of the paper can be easily supplied to the paper discharge roller. Consequently, the paper can be easily discharged through frictional force between the paper and the paper discharge roller.

In the aforementioned thermal transfer printer according to the second aspect, the horizontal distance between an end of the paper discharge roller closer to the paper support member and an end of the paper support member closer to the paper discharge roller is preferably smaller than the outer diameters of the paper discharge roller and the paper support member. According to this structure, the distance between the paper support member and the paper discharge roller can be so reduced as to increase the contact force of the paper coming into contact with the paper discharge roller. Thus, the frictional force generated in paper carriage can also be increased. Consequently, the paper can be easily carried.

The aforementioned thermal transfer printer according to the second aspect preferably further comprises a paper guide guiding the paper carried by the feed roller to the paper discharge roller, while the paper is preferably guided toward the paper discharge roller by the paper guide when carried by the feed roller, and supported by the paper support member when separated from the feed roller and carried by the paper discharge roller. According to this structure, the paper separated from the feed roller can be easily guided to the paper discharge roller.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention is now described with reference to the drawings.

The structure of a thermal transfer printer according to this embodiment is described with reference to FIGS. 1 to 7. The embodiment of the present invention is applied to the thermal transfer printer, which is an exemplary image generating apparatus.

Figure 1:
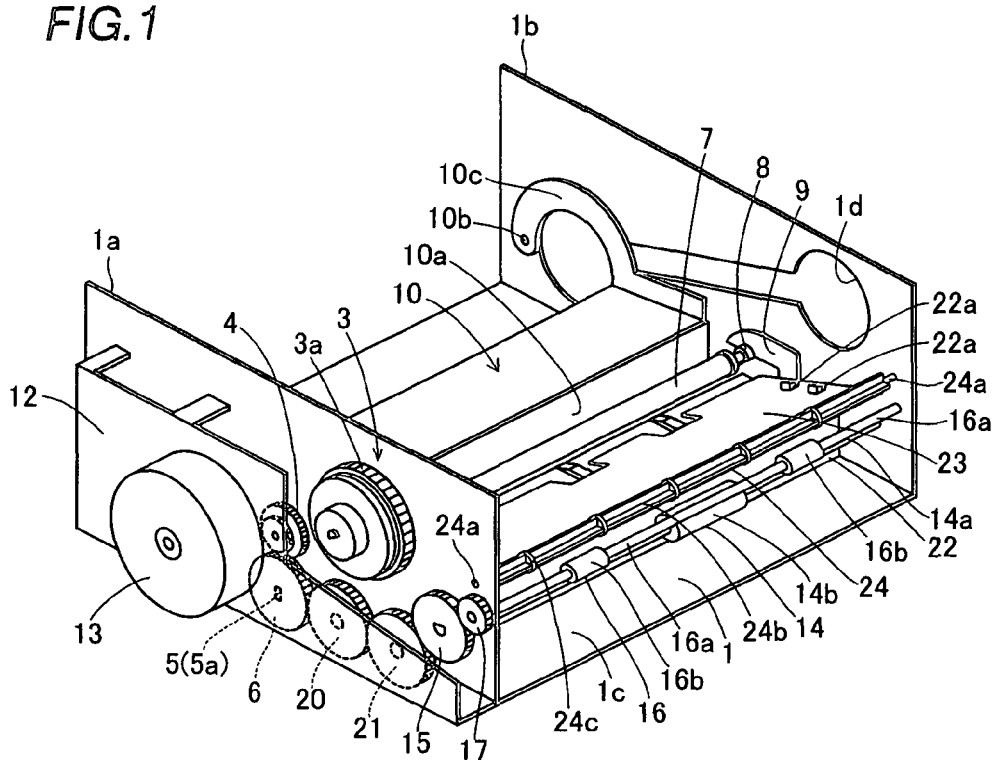
FIG. 1 is a perspective view showing the internal structure of a thermal transfer printer according to an embodiment of the present invention.
Figure 2:
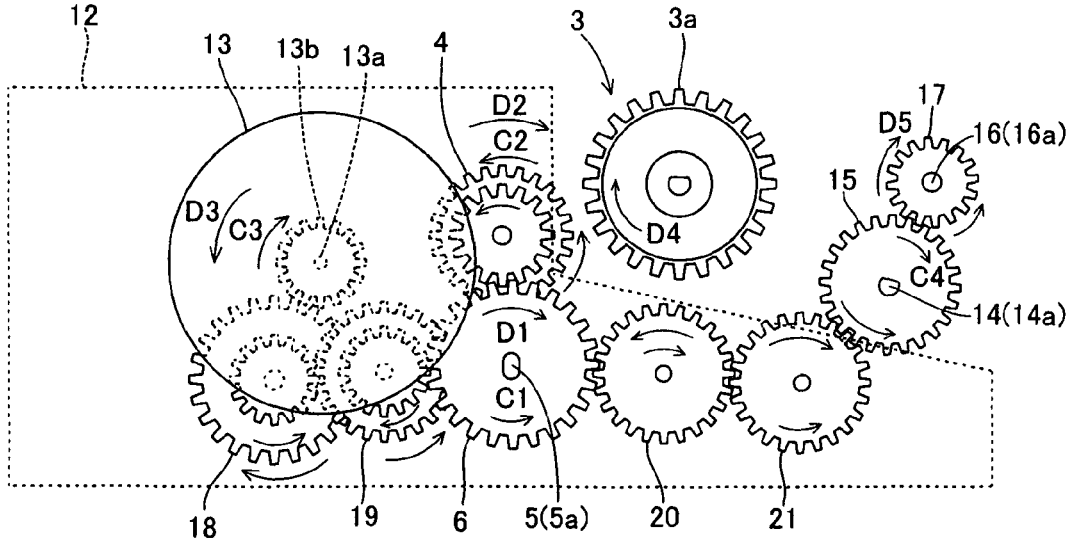
FIG. 2 is a front elevational view showing a motor and gears of the thermal transfer printer according to the embodiment shown in FIG. 1.
Figure 3:
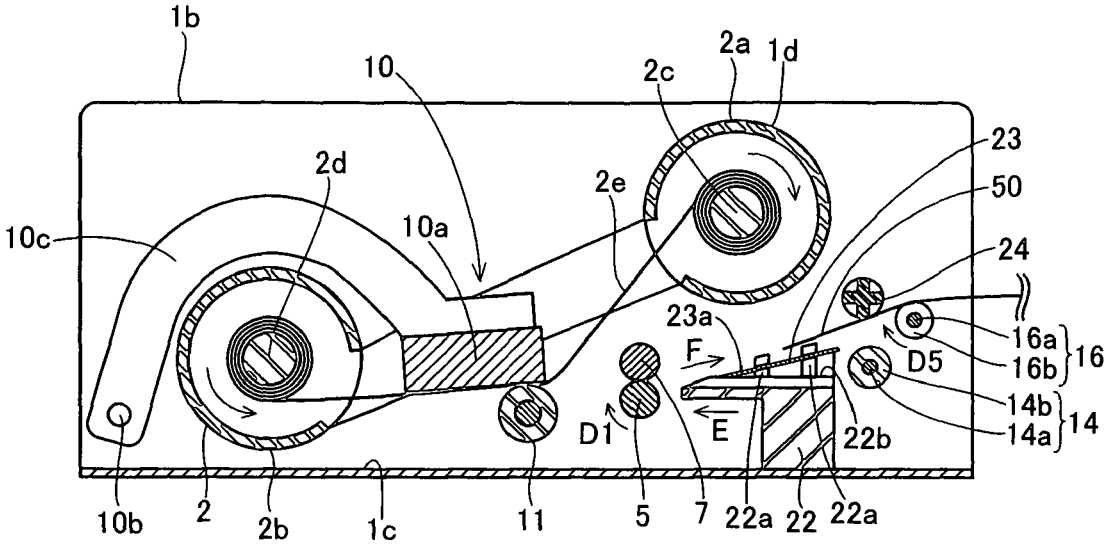
FIG. 3 is a sectional view of the thermal transfer printer according to the embodiment shown in FIG. 1 mounted with an ink sheet cartridge.

As shown in FIGS. 1 to 3, the thermal transfer printer according to this embodiment comprises a metal chassis 1, an ink sheet cartridge 2 (see FIG. 3), a take-up reel 3, a swing gear 4, a metal feed roller 5, a feed roller gear 6, a metal press roller 7 pressing the feed roller 5 with prescribed pressing force, a press roller bearing 8, a bearing support plate 9, a print head 10 for printing, a platen roller 11 opposed to the print head 10, a metal motor bracket 12, a motor 13, a paper feed roller 14, a paper feed roller gear 15 mounted on the paper feed roller 14, a single or only one paper discharge roller 16, a paper discharge roller gear 17 mounted on the paper discharge roller 16, a plurality of intermediate gears 18 to 21, a resin lower paper guide 22, a resin upper paper guide 23 and a resin paper support roller 24. The paper support roller 24 is an example of the "paper support member" in the present invention.

The chassis 1 has a first side surface 1*a* and a second side surface 1*b* opposed to each other and a bottom surface 1*c*, as shown in FIG. 1. The aforementioned motor bracket 12 is mounted on the first side surface 1*a* of the chassis 1. The second side surface 1*b* of the chassis 1 is provided with an ink sheet cartridge receiving hole 1*d* for receiving the ink sheet cartridge 2 (see FIG. 3). The ink sheet cartridge 2 has a take-up portion 2*a* and a feed portion 2*b*, as shown in FIG. 3. A take-up bobbin 2*c* and a feed bobbin 2*d* are rotatably arranged in the take-up portion 2*a* and the feed portion 2*b* respectively. An ink sheet 2*e* is wound on the take-up bobbin 2*c* and the feed bobbin 2*d*.

The take-up reel 3 is formed to engage with the take-up bobbin 2*c* of the take-up portion 2*a* of the ink sheet cartridge 2, and has a function of taking up the ink sheet 2*e* wound on the take-up bobbin 2*c* and the feed bobbin 2*c*. A gear portion 3*a* of the take-up reel 3 is arranged to mesh with the swing gear 4 upon swinging thereof, as shown in FIG. 2. The swing gear 4 is rendered to swing following rotation of the feed roller gear 6. More specifically, the swing gear 4 swings along arrow C2 in FIG. 2 when the feed roller gear 6 rotates along arrow C1 in FIG. 2, while the former swings along arrow D2 in FIG. 2 when the latter rotates along arrow D1 in FIG. 2. The swing gear 4 is arranged on a position for meshing with the gear portion 3*a* of the take-up reel 3 when swinging along arrow D2 in FIG. 2.

The feed roller 5 is formed to rotate following rotation of the feed roller gear 6, and has a function of carrying a paper 50 in a paper feed direction (along arrow E in FIG. 3) and a paper discharge direction (along arrow F in FIG. 3). The feed roller 5 includes a gear insert portion 5*a* (see FIGS. 1 and 2) inserted into the feed roller gear 6. The press roller 7 is rotatably supported on the press roller bearing 8, as shown in FIG. 1. This press roller bearing 8 is mounted on the bearing support plate 9. The bearing support plate 9, formed to press the press roller 7 against the feed roller 5 with prescribed pressing force, is provided inside the first and second side surfaces 1*a* and 1*b* of the chassis 1. Thus, the thermal transfer printer can hold the paper 50 with the feed roller 5 and the press roller 7 for carrying the held paper 50 in the paper feed direction (along arrow E in FIG. 3) and the paper discharge direction (along arrow F in FIG. 3).

The print head 10 has a head portion 10*a* for printing, support shafts 10*b* rotatably mounted on the first and second side surfaces 1*a* and 1*b* of the chassis 1 and arm portions 10*c* provided to couple the head portion 10*a* and the support shafts 10*b* with each other. The arm portions 10*c* of the print head 10 are rotatable about the support shafts 10*b*, for rotating the head portion 10*a* toward the platen roller 11 in printing. The platen roller 11 is rotatably supported on platen roller bearings (not shown) mounted on the first and second side surfaces 1*a* and 1*b* of the chassis 1.

As shown in FIG. 2, a motor gear 13*b* is mounted on a shaft portion 13*a* of the motor 13 mounted on the motor bracket 12. The motor 13 functions as a drive source for driving the gear portion 3*a* of the take-up reel 3, the feed roller gear 6, the paper feed roller gear 15, the paper discharge roller gear 17 and the intermediate gears 18 to 21.

Figure 4:
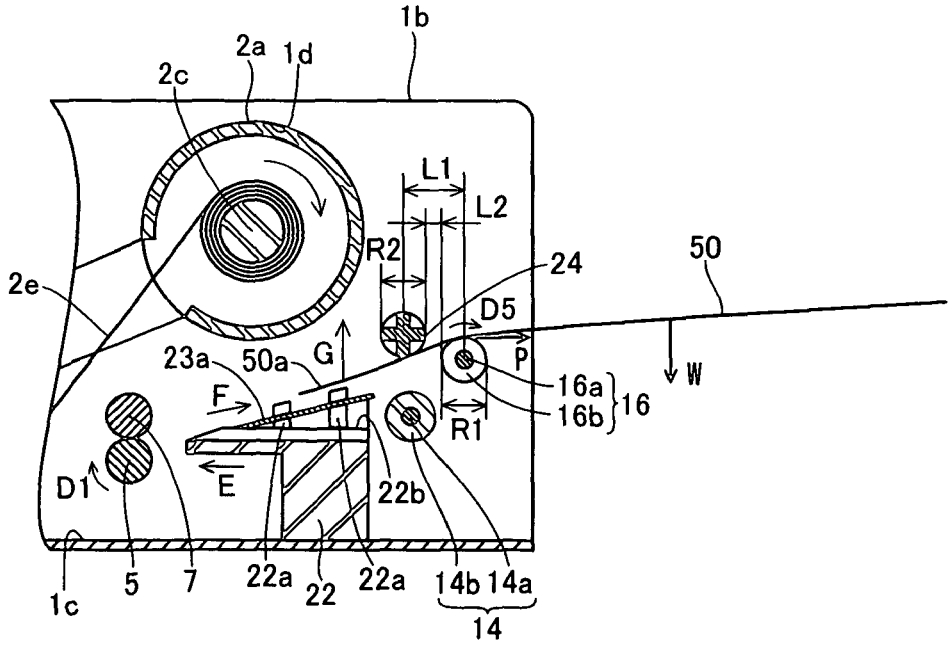
FIG. 4 is an enlarged sectional view of the thermal transfer printer according to the embodiment shown in FIG. 1 mounted with the ink sheet cartridge.

The paper feed roller 14 is provided for feeding the paper 50 to a printing position for performing printing with the head portion 10*a* of the print head 10. The paper feed roller 14 has a metal shaft portion 14*a* and a rubber roller portion 14*b* engaged with the shaft portion 14*a*, as shown in FIGS. 1, 3 and 4. The paper feed roller gear 15 is mounted on an end of the shaft portion 14*a* of the paper feed roller 14 closer to the first side surface 1*a* of the chassis 1, as shown in FIG. 2.

Figure 6:
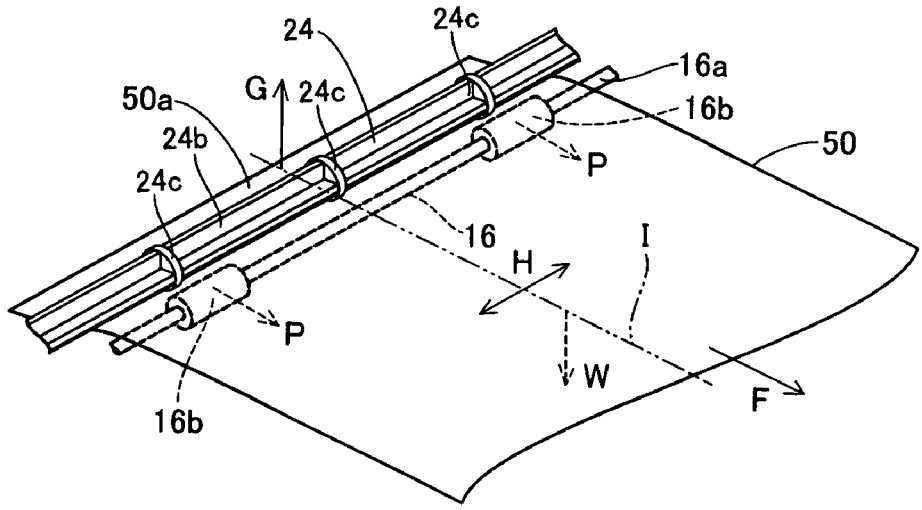
FIG. 6 is a perspective view of a paper support roller and a carrier roller of the thermal transfer printer according to the embodiment shown in FIG. 1.

According to this embodiment, the paper discharge roller 16 is provided for discharging the printed paper 50 subjected to printing with the head portion 10*a* of the print head 10. More specifically, the paper discharge roller 16 is so formed as to discharge the printed paper 50 with frictional force P generated between the same and the lower surface of the printed paper 50 coming into contact with the paper discharge roller 16 with prescribed contact force, as shown in FIG. 4. The paper discharge roller 16 has a metal shaft portion 16*a* and two rubber roller portions 16*b*, having an outer diameter R1 (about 5.0 mm), engaged with the shaft portion 16*a*, as shown in FIGS. 1, 3 and 4. As shown in FIG. 6, the two roller portions 16*b* are located on positions, corresponding to rib portions 24*c* of the paper support roller 24 described later, symmetrical with respect to the central position I of the width of the paper 50 in a direction (along arrow H in FIG. 6) perpendicular to the paper discharge direction (along arrow F in FIG. 6). The paper discharge roller gear 17 is mounted on an end of the shaft portion 16*a* of the paper discharge roller 16 closer to the first side surface 1*a* of the chassis 1, as shown in FIG. 2.

The lower paper guide 22 is set in the vicinity of the paper feed roller 14, as shown in FIGS. 3 and 4. This lower paper guide 22 is provided with a support portion 22*a* supporting the upper paper guide 23 as described later. The lower paper guide 22 has a function of passing the paper 50 fed by the paper feed roller 14 through the upper surface 22*b* of the lower paper guide 22 in paper feeding, thereby guiding the same to a paper feed path toward the print head 10.

The upper paper guide 23 is supported by the support portion 22*a* of the lower paper guide 22. This upper paper guide 23 is supported in a state inclined by a prescribed angle with respect to the bottom surface 1*c* of the chassis 1. Thus, the upper paper guide 23 has a function of passing the paper 50 carried by the feed roller 5 through the upper surface 23*a* of the upper paper guide 23 supported in the state inclined by the prescribed angle thereby guiding the same to a paper discharge path toward the paper discharge roller 16 in paper discharging.

Figure 5:
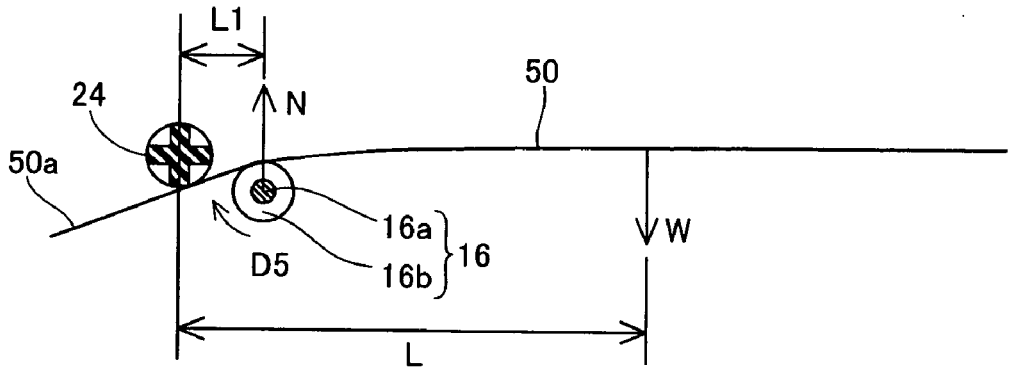
FIG. 5 is a schematic diagram for illustrating moments acting on a paper employed in the thermal transfer printer according to the embodiment shown in FIG. 1.

According to this embodiment, the paper support roller 24 of resin is provided at an interval L1 (about 7.0 mm) from the paper discharge roller 16 in the paper feed direction (along arrow E in FIGS. 3 and 4) so that the paper 50 discharged by the paper discharge roller 16 comes into contact with the paper discharge roller 16 with the prescribed contact force, as shown in FIG. 5. The paper support roller 24 is provided between the feed roller 5 and the paper discharge roller 16. The lower end of the paper support roller 24 is positioned below the upper ends of the roller portions 16*b* of the paper discharge roller 16. The paper support roller 24 is provided for supporting an end 50*a* of the paper 50, carried by the feed roller 5, in the paper feed direction upwardly moving due to the own weight of the paper 50, as shown in FIGS. 4 and 6. The paper 50 employed for the thermal transfer printer according to this embodiment has a thickness and a weight larger than those of a paper employed for an ink jet printer or a laser printer. When the printed paper 50 is detached from the feed roller 5 and the press roller 7, therefore, the end 50*a* supported by the paper discharge roller 16 by gravity W acting on the centroidal position of the printed paper 50 upwardly moves along arrow G shown in FIGS. 4 and 6. Therefore, the paper support roller 24 is set on a position for supporting the end 50*a* of the upper surface of the printed paper 50 upwardly moving along arrow G in FIGS. 4 and 6. Assuming that N represents the force of the paper discharge roller 16 pressing the paper 50 whose upper surface is supported by the paper support roller 24, L represents the distance between the centroidal position of the paper 50 and the paper support roller 24, L1 (about 7.0 mm) represents the distance between the axial centers of the paper discharge roller 16 and the paper support roller 24 and W represents the gravity on the centroidal position of the paper 50 as shown in FIG. 5, the equilibrium of moments around the paper 50 coming into contact with the paper support roller 24 satisfies the following expression (1) through a moment W×L acting on the centroidal position of the paper 50 and a moment N×L1 acting on the paper 50 coming into contact with the paper discharge roller 16:

$$W \times L = N \times L1 \tag{1}$$

The above expression (1) is arranged in relation to the force N of the paper discharge roller 16 pressing the paper 50 as follows:

$$N = (W \times L)/L1 \tag{2}$$

Assuming that μk represents the coefficient of dynamic friction of the rubber roller portions 16*b* of the paper discharge roller 16, the frictional force P acting on the paper 50 carried by the paper discharge roller 16 is expressed as follows:

$$P = \mu k \times N = \mu k \times (W \times L)/L1 \tag{3}$$

It is understood from the above expression (3) that the frictional force P is increased as the distance L1 between the axial centers of the paper discharge roller 16 and the paper support roller 24 is reduced.

Figure 7:
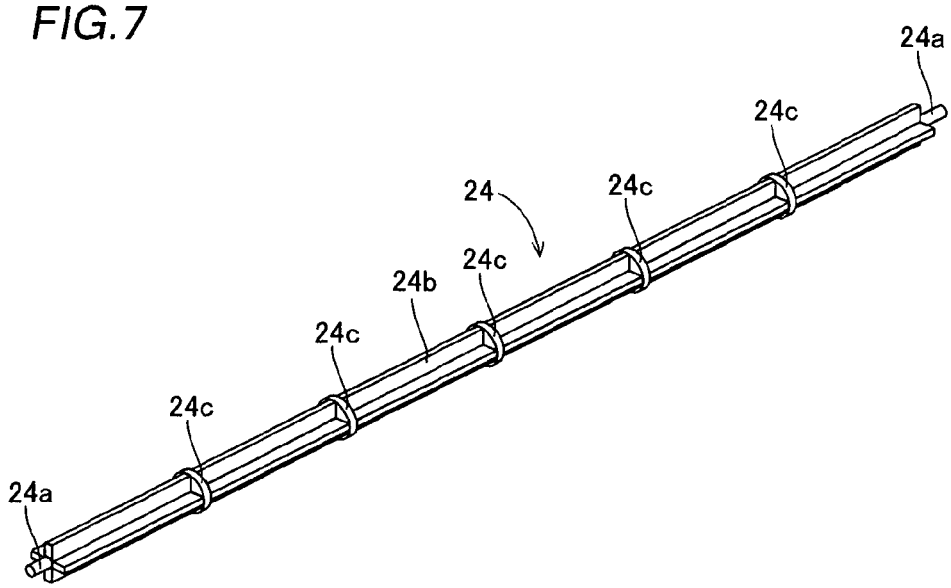
FIG. 7 is a perspective view of the paper support roller of the thermal transfer printer according to the embodiment shown in FIG. 1.

According to this embodiment, the paper support roller 24 has a shaft portion 24*a* rotatably supported on the first and second side surfaces 1*a* and 1*b* of the chassis 1, a body portion 24*b* having a cruciform section and a plurality of rib portions 24*c* having a circular section for reinforcing the body portion 24*b*, as shown in FIG. 7. The plurality of rib portions 24*c* of the paper support roller 24 are provided at prescribed intervals along the extensional direction of the paper support roller 24. Each rib portion 24*c* of the paper support roller 24 has an outer diameter R2 (about 6.0 mm), as shown in FIG. 4. The axial centers of the paper discharge roller 16 having the outer diameter R1 (about 5.0 mm) and the paper support roller 24 having the outer diameter R2 (about 6.0 mm) are provided at the interval L1 (about 7.0 mm), whereby the paper support roller 24 and the paper discharge roller 16 are arranged at an interval L2 (about 1.5 mm) in the paper feed direction (along arrow E in FIG. 4), not to come into contact with each other. This interval L2 (about 1.5 mm) is smaller than the outer diameter R1 (about 5.0 mm) of the roller portions 16*b* of the paper discharge roller 16 and the outer diameter R2 (about 6.0 mm) of the rib portions 24*c* of the paper support roller 24.

A paper carrying operation following a printing operation of the thermal transfer printer according to this embodiment is now described with reference to FIGS. 2 to 4 and 8 to 10.

Figure 8:
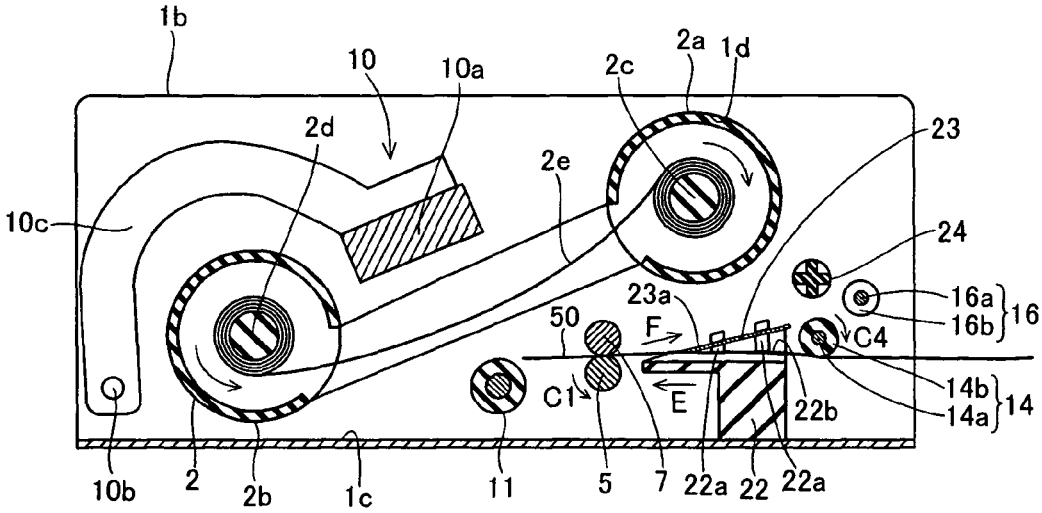
FIGS. 8 to 10 are sectional views for illustrating a paper carrying operation of the thermal transfer printer according to the embodiment shown in FIG. 1 following a printing operation.
Figure 9:
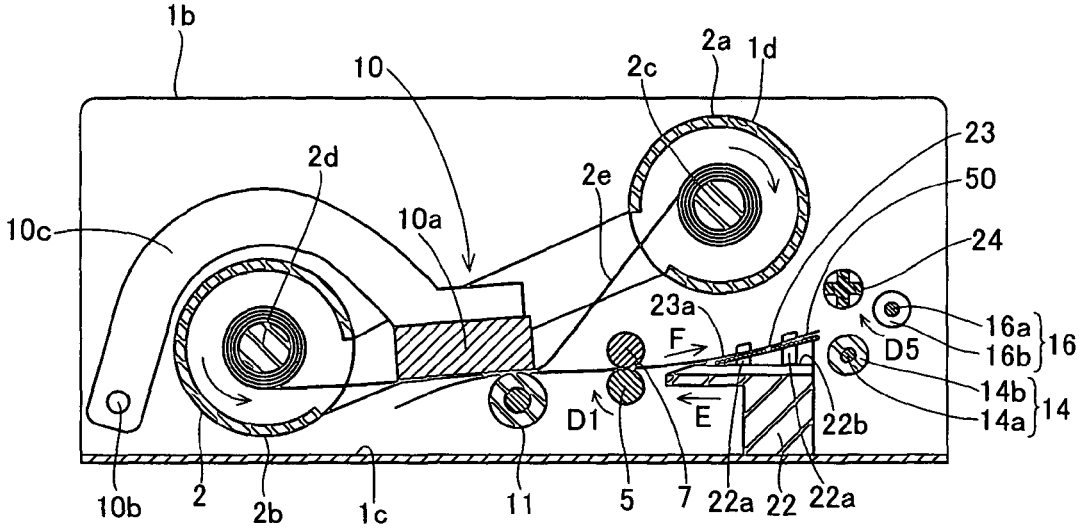

In paper feeding, the motor 13 is so driven that the motor gear 13*b* mounted on the motor 13 rotates along arrow C3 in FIG. 2 and the feed roller gear 6 rotates along arrow C1 in FIG. 2 through the intermediate gears 18 and 19, as shown in FIG. 2. Following the rotation of the feed roller gear 6 along arrow C1 in FIG. 2, the paper feed roller gear 15 rotates along arrow C4 in FIG. 2 through the intermediate gears 20 and 21. Thus, the paper feed roller 14 rotates along arrow C4 in FIG. 8 following the rotation of the paper feed roller gear 15 as shown in FIG. 8, thereby carrying the paper 50 coming into contact with the lower surface of the roller portion 14*b* of the paper feed roller 14 in the paper feed direction (along arrow E in FIG. 8). Thereafter the paper feed roller 14 feeds the paper 50 to a position carriable by the feed roller 5 and the press roller 7 while the lower paper guide 22 guides the same along the paper feed direction.

At this time, the feed roller 5 rotates along arrow C1 in FIG. 8 following the rotation of the feed roller gear 6 along arrow C1 in FIG. 2, thereby carrying the paper 50 in the paper feed direction (along arrow E in FIG. 8). The swingable swing gear 4 (see FIG. 2) swings in a direction (along arrow C2 in FIG. 2) for separating from the gear portion 3*a* of the take-up reel 3, not to mesh with the gear portion 3*a*. Thus, the gear portion 3*a* of the take-up reel 3 does not rotate in paper feeding, not to take up the ink sheet 2*e* wound on the take-up bobbin 2*c* and the feed bobbin 2*d*.

In printing, the motor 13 is so driven that the motor gear 13*b* mounted thereon rotates along arrow D3 in FIG. 2 and the feed roller gear 6 rotates along arrow D1 in FIG. 2 through the intermediate gears 18 and 19, as shown in FIG. 2. Thus, the feed roller 5 rotates along arrow D1 in FIG. 9 following the rotation of the feed roller gear 6 along arrow D1 in FIG. 2, thereby carrying the paper 50 in the paper discharge direction (along arrow E in FIG. 9). The swingable swing gear 4 (see FIG. 2) swings in a direction (along arrow D2 in FIG. 2) for meshing with the gear portion 3*a* of the take-up reel 3, to mesh with this gear portion 3*a*. Thus, the gear portion 3*a* of the take-up reel 3 rotates along arrow D4 in FIG. 2, thereby taking up the ink sheet 2*e* wound on the take-up bobbin 2*c* and the feed bobbin 2*d*. At this time, the head portion 10*a* of the print head 10 rotates toward the platen roller 11, so that the thermal transfer printer performs printing on the paper 50 while carrying the paper 50 in the paper discharge direction and taking up the ink sheet 2*e*.

Figure 10:
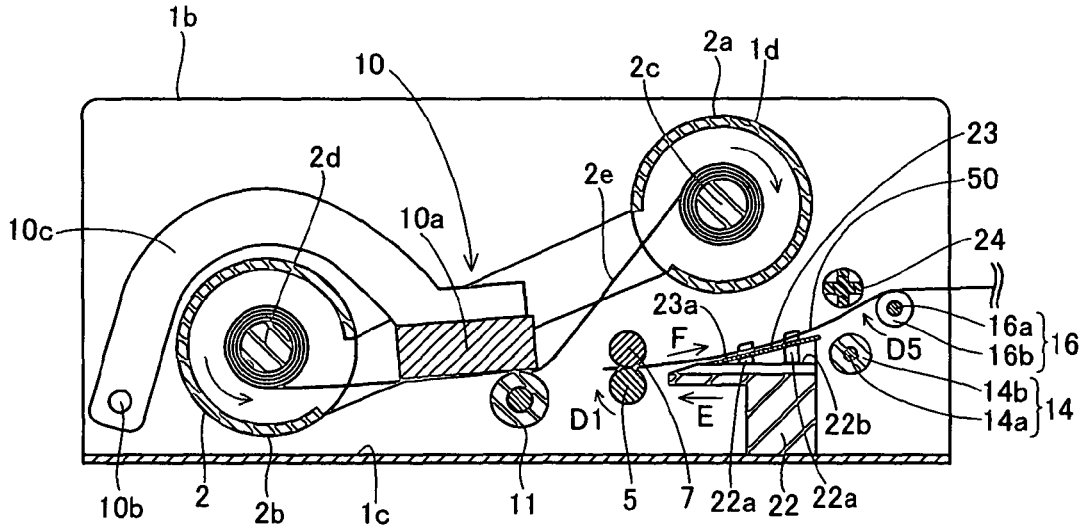

In paper discharge, the printed paper 50 subjected to the printing with the head portion 10*a* of the print head 10 is guided by the upper paper guide 23 and carried to a position carriable by the paper discharge roller 16, as show in FIG. 10. At this time, the paper discharge roller gear 17 rotates along arrow D5 in FIG. 2 through the intermediate gears 20 and 21 and the paper feed roller gear 15 following rotation of the feed roller gear 6 along arrow D1 in FIG. 2. Thus, the paper discharge roller 16 rotates along arrow D5 in FIG. 10 following the rotation of the paper discharge roller gear 17, thereby carrying the printed paper 50 coming into contact with the upper surfaces of the roller portions 16*b* of the paper discharge roller 16 in the paper discharge direction (along arrow F in FIG. 10).

Thereafter the printed paper 50 is detached from the feed roller 5 and the press roller 7 and carried in the paper discharge direction (along arrow F in FIGS. 3 and 4) by the paper discharge roller 16, as shown in FIGS. 3 and 4. At this time, the end 50*a* of the printed paper 50, detached from the feed roller 5 and the press roller 7, in the paper feed direction (along arrow E in FIGS. 3 and 4) upwardly moves along arrow G in FIG. 4 due to the gravity W generated on the centroidal position of the printed paper 50. According to this embodiment, the paper support roller 24 can support this upward movement of the end 50*a* of the printed paper 50 along arrow G in FIG. 4, thereby maintaining the state of supplying the prescribed contact force to the roller portions 16*b* of the paper discharge roller 16. In other words, the paper support roller 24 is so provided as to maintain the state where the force N of the paper discharge roller 16 pressing the paper 50 shown in the above expression (2) acts on the roller portions 16*b* of the paper discharge roller 16. Thus, the paper discharge roller 16 discharges the printed paper 50 from the thermal transfer printer due to the frictional force P ($\mu k \times N$) generated between the roller portions 16*b* thereof and the printed paper 50 shown in the above expression (3).

Figure 11:
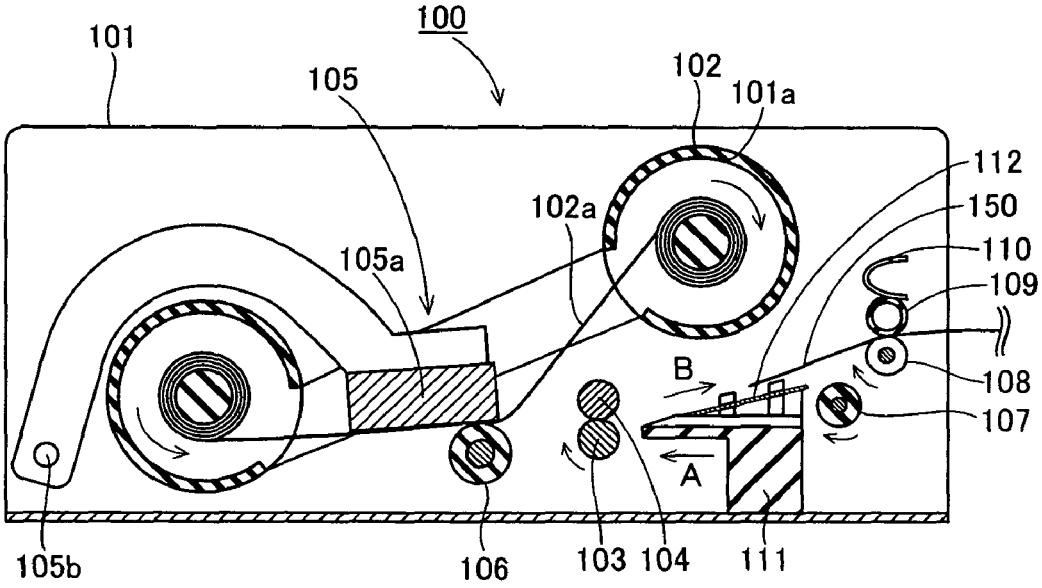
FIG. 11 PRIOR ART
FIG. 11 is a sectional view of an exemplary conventional thermal transfer printer.

According to this embodiment, as hereinabove described, the paper support roller 24 supporting the upper surface of the paper 50 at the interval L1 (about 7.0 mm) in the paper feed direction (along arrow E in FIG. 4) with respect to the axial center of the paper discharge roller 16 is so provided that the lower surface of the paper 50 discharged by the paper discharge roller 16 comes into contact with the paper discharge roller 16 with the prescribed contact force, whereby the paper support roller 24 provided at the interval L1 (about 7.0 mm) in the paper feed direction with respect to the axial center of the paper discharge roller 16 can support the upward movement of the end 50*a* of the upper surface of the paper 50 in the paper feed direction when the gravity of the paper 50 moves in the paper discharge direction with respect to the axial center of the paper discharge roller 16 after the paper 50 carried by the feed roller 5 and the press roller 7 is detached from these rollers 5 and 7. When the paper support roller 24 supports the end 50*a* of the upper surface of the paper 50 in the paper feed direction, the force N(=(W×L)/L1) for pressing the lower surface of the paper 50 against the paper discharge roller 16 so acts that the frictional force P ($=\mu k \times N$) can be generated between the paper discharge roller 16 and the paper 50. Therefore, the paper discharge roller 16 can carry the paper 50 along the paper discharge direction. Consequently, the paper 50 can be carried in the paper discharge direction without employing a spring member 110 dissimilarly to the case of carrying the paper 150 by urging the paper press roller 109 toward the paper discharge roller 108 with the spring member 110 thereby generating frictional force between the paper discharge roller 108 and the paper 150 in the conventional thermal transfer printer 100 shown in FIG. 11, whereby the number of components can be reduced due to the unnecessariness for a member such as the spring member 110 of the conventional thermal transfer printer 100. Further, the thermal transfer printer according to this embodiment can discharge the paper 50 with the simple structure of providing the paper support roller 24 at the interval L1 (about 7.0 mm) in the paper feed direction with respect to the axial center of the paper discharge roller 16.

According to this embodiment, the paper support roller 24 is provided between the feed roller 5 and the paper discharge roller 16 for supporting the end 50*a* of the paper 50, carried by the feed roller 5, in the paper feed direction (along arrow E in FIG. 4) upwardly moving with reference to a supporting point formed by the paper discharge roller 16 due to the own weight of the portion of the paper 50 passing through the paper discharge roller 16, thereby easily supporting the upward movement of the end 50*a* of the paper 50 in the paper feed direction along arrow G in FIG. 4 when the gravity of the paper 50 moves in the paper discharge direction (along arrow F in FIG. 4) with respect to the axial center of the paper discharge roller 16.

According to this embodiment, the paper support roller 24 is so rotatably provided with respect to the chassis 1 that the upper surface of the paper 50 can be smoothly carried due to the rotation of the paper support roller 24 following the rotation of the paper 50 when the paper discharge roller 16 carries the lower surface of the paper 50 in the paper discharge direction (along arrow F in FIG. 4) while the paper support roller 24 supports the end 50*a* of the upper surface of the paper 50 in the paper feed direction (along arrow E in FIG. 4). Also when the upper surface of the paper 50 supported by the paper support roller 24 is printed, the rotatable paper support roller 24 can so smoothly carry the paper 50 that the thermal transfer printer can discharge the printed paper 50 without damaging the state of the image such as a photograph formed on the printed surface of the paper 50.

According to this embodiment, the paper support roller 24 of resin and the rubber roller portions 16*b* of the paper discharge roller 16 are so provided that the frictional force P (=μk×N) generated between the rubber roller portions 16*b* of the paper discharge roller 16 and the paper 50 is larger than the frictional force generated between the paper support roller 24 of resin and the paper 50, whereby the paper discharge roller 16 can easily discharge the paper 50 in the paper discharge direction (along arrow F in FIG. 4).

Although the present invention has been described and illustrated in detail, it is clearly understood that the same is by way of illustration and example only and is not to be taken by way of limitation, the spirit and scope of the present invention being limited only by the terms of the appended claims.

For example, while the aforementioned embodiment of the present invention is applied to the thermal transfer printer, the present invention is not restricted to this but is also applicable to another image generating apparatus other than the thermal transfer printer.

While the chassis rotatably supports the shaft portion of the paper support roller in the aforementioned embodiment, the present invention is not restricted to this but the paper support roller may alternatively be unrotatably fixed to the chassis.

While the roller portions of rubber are mounted on the shaft portion of the paper discharge roller for discharging the paper through the frictional force generated between the paper discharge roller and the paper in the aforementioned embodiment, the present invention is not restricted to this but the paper discharge roller may be prepared from any material capable of attaining frictional force necessary for carrying the paper coming into contact with the paper discharge roller with the prescribed contact force.

What is claimed is:

1. An image generating apparatus comprising:

a feed roller for carrying a paper;

a paper discharge roller coming into contact with the lower surface of said paper for discharging said paper carried by said feed roller; and a paper support member arranged at a prescribed interval from the axial center of said paper discharge roller in a paper feed direction while supporting the upper surface of said paper so that the lower surface of said paper discharged by said paper discharge roller comes into contact with said paper discharge roller with prescribed contact force, wherein said paper discharge roller discharges said paper with frictional force generated between said paper discharge roller and the lower surface of said paper coming into contact with said paper discharge roller with said prescribed contact force, wherein said paper support member of resin includes a body portion having a cruciform section and rib portions, having a circular section, provided at a prescribed interval along the extensional direction of said paper support member.

2. The image generating apparatus according to claim 1, wherein said roller portion of said paper discharge roller has a pair of rollers arranged on positions symmetrical with respect to the central position of the width of said paper in a direction perpendicular to a paper discharge direction, and said rib portions of said paper support member are provided on positions corresponding to said pair of rollers.

3. A thermal transfer printer comprising:

a feed roller for carrying a paper;

a paper discharge roller coming into contact with a lower surface of said paper while for discharging said paper carried by said feed roller; and a rotatably provided paper support member of resin arranged at a prescribed interval from the axial center of said paper discharge roller in a paper feed direction while supporting an upper surface of said paper so that the lower surface of said paper discharged by said paper discharge roller comes into contact with said paper discharge roller with prescribed contact force, wherein said paper discharge roller and said paper support member are arranged not to come into contact with each other, said paper support member is provided between said feed roller and said paper discharge roller for supporting the rear end of said paper, carried by said feed roller, upwardly moving with reference to a supporting point formed by said paper discharge roller due to the own weight of a portion of said paper passing though said paper discharge roller, said paper discharge roller includes a roller portion of rubber and discharges said paper with frictional force generated between said paper discharge roller and the lower surface of said paper coming into contact with said paper discharge roller with said prescribed contact force, and said paper support member of resin includes a body portion having a cruciform section and rib portions, having a circular section, provided at a prescribed interval along the extensional direction of said paper support member.

4. The thermal transfer printer according to claim 3, wherein said roller portion of said paper discharge roller has a pair of rollers arranged on positions symmetrical with respect to the central position of the width of said paper in a direction perpendicular to a paper discharge direction, and said rib portions of said paper support member are provided on positions corresponding to said pair of rollers.

* * * * *